US006553571B1

(12) United States Patent
Guenther et al.

(10) Patent No.: US 6,553,571 B1
(45) Date of Patent: Apr. 29, 2003

(54) BASEBALL GLOVE WITH FINGER WRAP

(75) Inventors: Douglas G. Guenther, Wheaton, IL (US); Bradley C. Gaff, Newburgh, IN (US)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

(21) Appl. No.: 10/059,730

(22) Filed: Jan. 29, 2002

(51) Int. Cl.[7] ..... A41D 13/08
(52) U.S. Cl. ..... 2/19; 2/161.1
(58) Field of Search ..... 2/19, 16, 20, 159, 2/161.1, 161.6, 163, 164, 169

(56) References Cited

U.S. PATENT DOCUMENTS

| | | | | | |
|---|---|---|---|---|---|
| 1,000,567 | A | * | 8/1911 | Whitley | 2/19 |
| 3,300,787 | A | * | 1/1967 | Denkert | 2/19 |
| 3,576,036 | A | * | 4/1971 | Latina | 2/19 |
| 4,295,229 | A | * | 10/1981 | Clark et al. | 2/161.1 |
| 4,665,561 | A | | 5/1987 | Aoki | 2/160 |
| 4,748,690 | A | | 6/1988 | Webster | 2/19 |
| 5,528,772 | A | | 6/1996 | Cheek | 2/161 |
| 5,575,005 | A | | 11/1996 | Walker et al. | 2/19 |
| 5,689,828 | A | | 11/1997 | Mah | 2/16 |

* cited by examiner

*Primary Examiner*—Gary Welch

(57) ABSTRACT

A ball glove includes an inner lining which includes a plurality of finger stalls which provide finger openings. Each finger stall is formed by a front palm lining and a back lining. The front palm lining is curved to provide a concavely curved front wall for each finger opening, and the back lining provides a back wall for each finger opening. The front palm lining includes side edges for each finger stall, and the back lining is secured to the side edges by lines of stitching which are spaced rearwardly from the curved front wall.

9 Claims, 7 Drawing Sheets

PRIOR ART

BASEBALL GLOVE WITH FINGER WRAP

BACKGROUND

This invention relates to baseball gloves, and, more particularly, to a baseball glove having an inner lining which wraps around the front of the fingers of the player.

Baseball gloves conventionally include an outer shell and an inner lining. The inner lining provides finger stalls for the player's fingers and thumb. Conventional inner linings include a substantially flat front palm lining which forms a front wall for each finger stall and a back lining which forms a back wall for each finger stall. The back lining is stitched to the substantially flat palm lining along the front of each finger stall. The seams between the back lining and the palm lining are easily felt by the player's fingers, which are more sensitive on their palm sides. The seams therefore can cause some discomfort to the player.

SUMMARY OF THE INVENTION

The invention provides an inner lining in which the palm lining provides a curved front wall and side walls for each finger stall. The seams between the back lining and palm lining are positioned along the less sensitive backs of the fingers. The lining is therefore more comfortable.

The curved front walls wrap around the fingers like a hammock and provide more surface contact with the front and side surfaces of the fingers. The player therefore has better control over the glove.

DESCRIPTION OF THE DRAWING

The invention will be explained in conjunction with illustrative embodiments shown in the accompanying drawing, in which—

DESCRIPTION OF SPECIFIC EMBODIMENT

Figure 1:
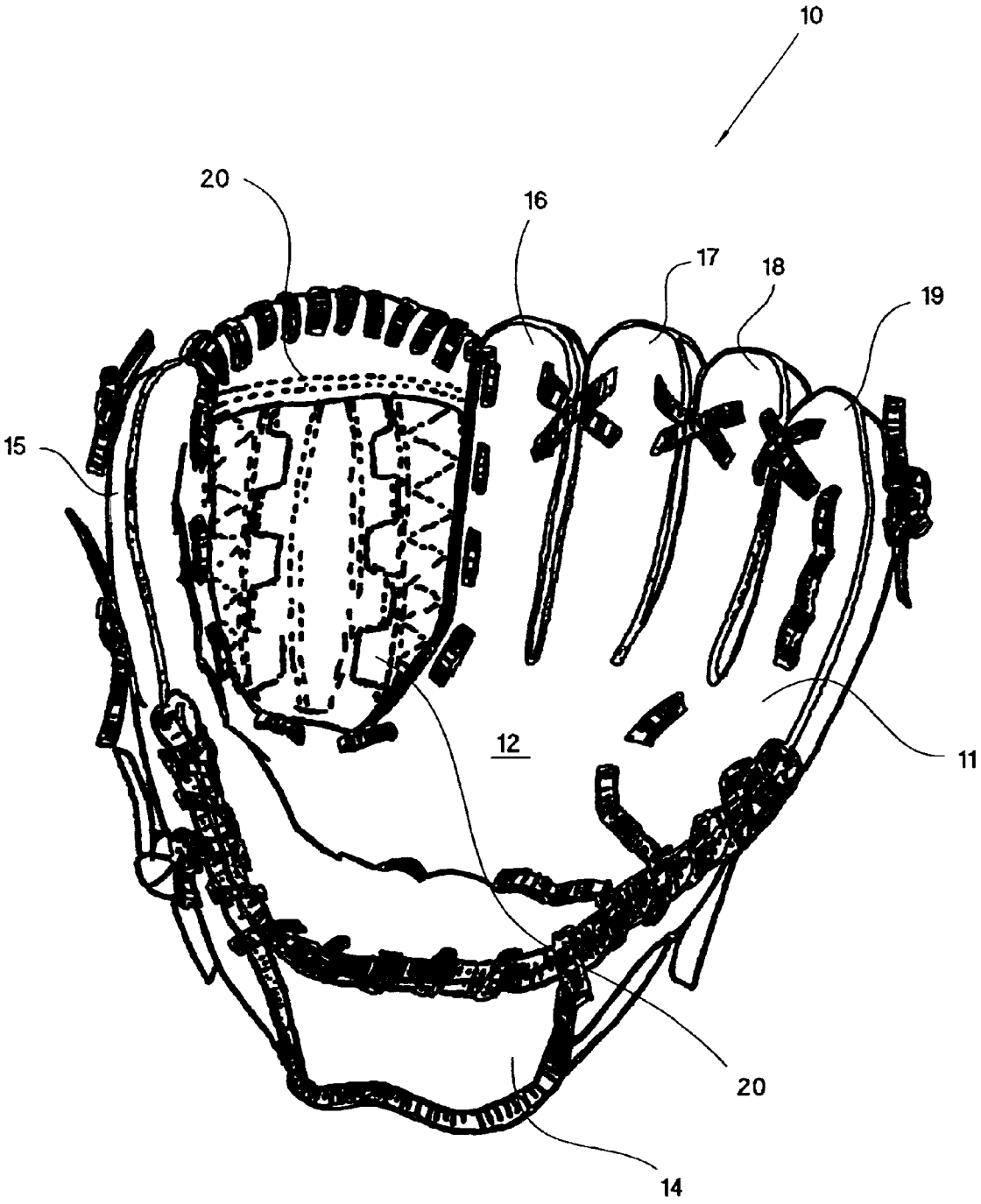
FIG. 1 is a front perspective view of a baseball glove which includes an inner lining in accordance with the invention.
Figure 2:
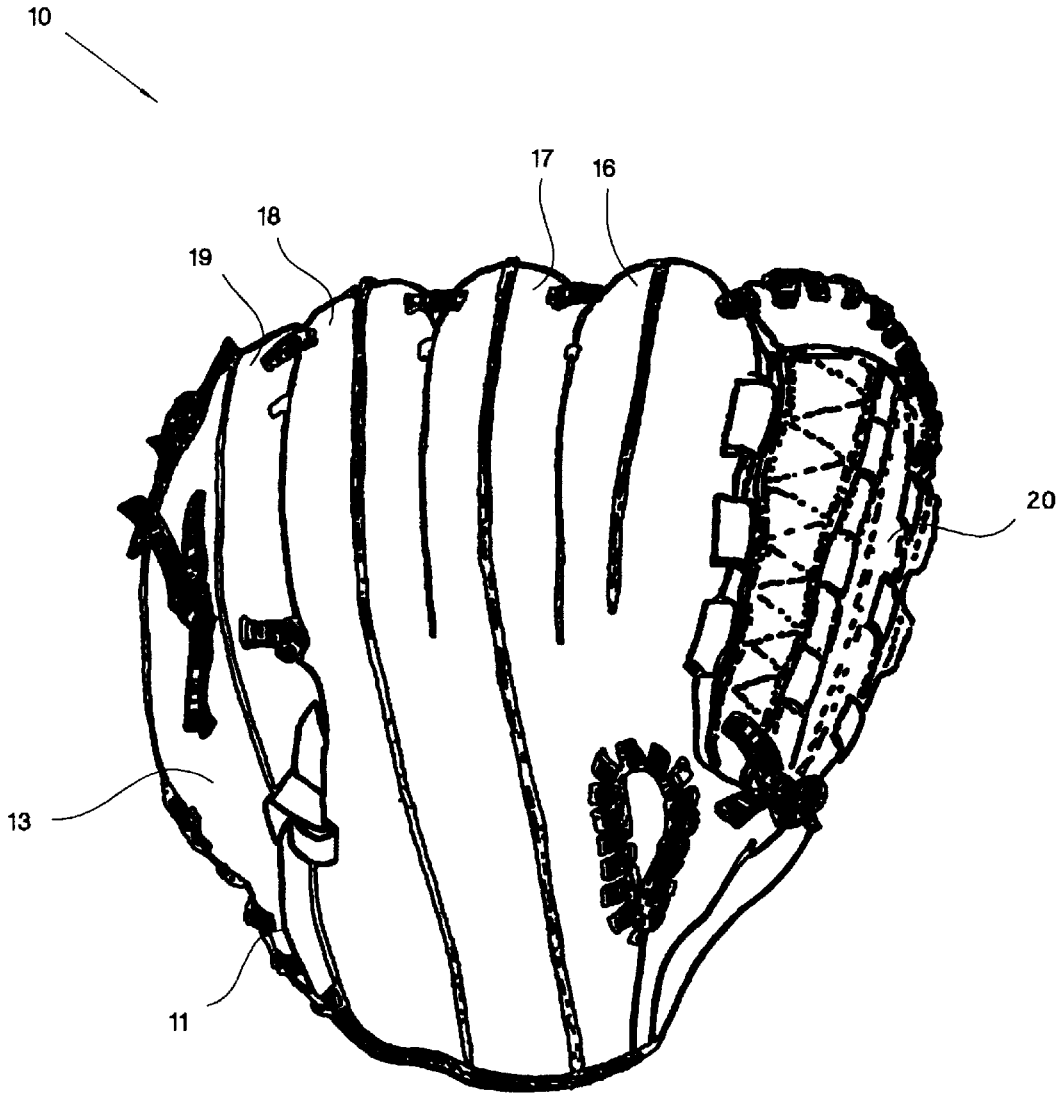
FIG. 2 is a rear perspective view of the glove of FIG. 1.
Figure 3:
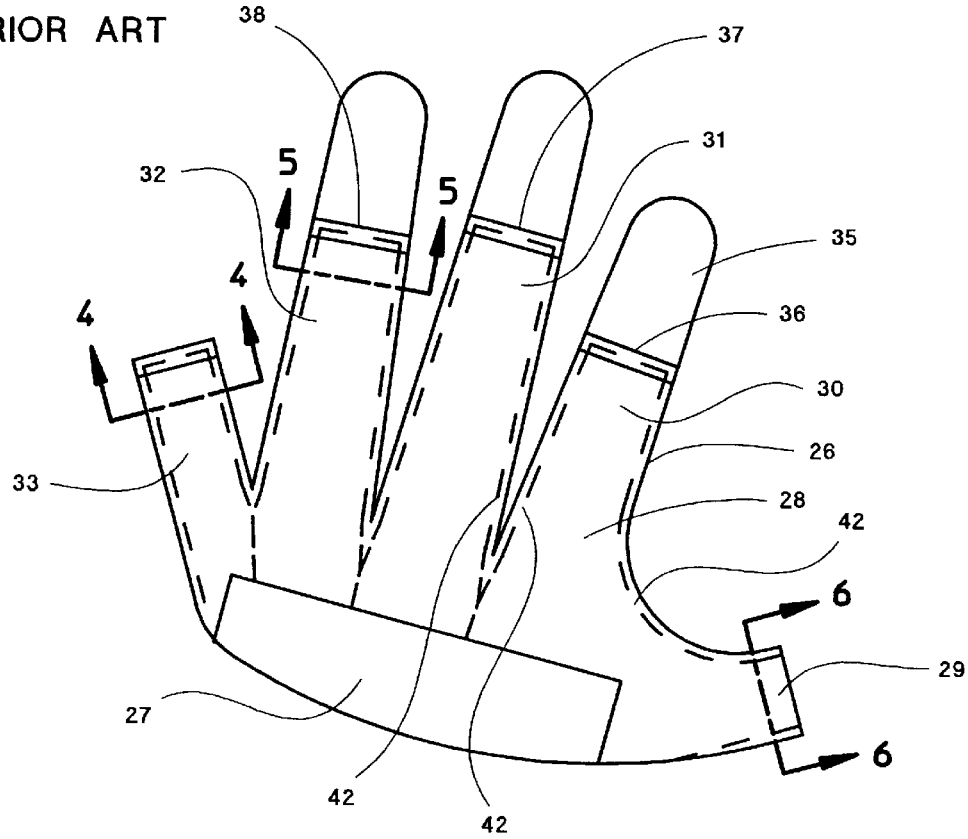
FIG.3 PRIOR ART
FIG. 3 is a back view of a prior art inner lining of a baseball glove.

Referring to FIGS. 1 and 2, a baseball glove 10 includes an outer shell 11 which is formed by a front ply 12 and a back ply 13. The plies are separated along their bottom edges to provide a hand opening 14. The front and back plies form a thumb stall 15 and four finger stalls 16, 17, 18, and 19 for receiving the thumb and four fingers of the player, respectively. A webbing 20 extends between, and is secured to, the thumb stall 15 and the forefinger stall 16.

Although the invention will be described with respect to a baseball glove, it will be understood that the invention can be used with other ball gloves, e.g., softball gloves.

The outer shell 11 that has been described is a conventional prior art outer shell. The novelty of the invention resides in the inner lining which will be described hereinafter.

FIGS. 3–7 illustrate a prior art inner lining 26 which can be used with the outer shell 11 of FIGS. 1 and 2. The inner lining 26 includes a front or palm lining 27 and a back lining 28. The palm lining 27 and back lining 28 form a thumb lining stall 29 and four finger lining stalls 30, 31, 32, and 33 which fit inside of the thumb stall 15 and the four finger stalls 16-19 of the outer shell 11, respectively.

Figure 7:
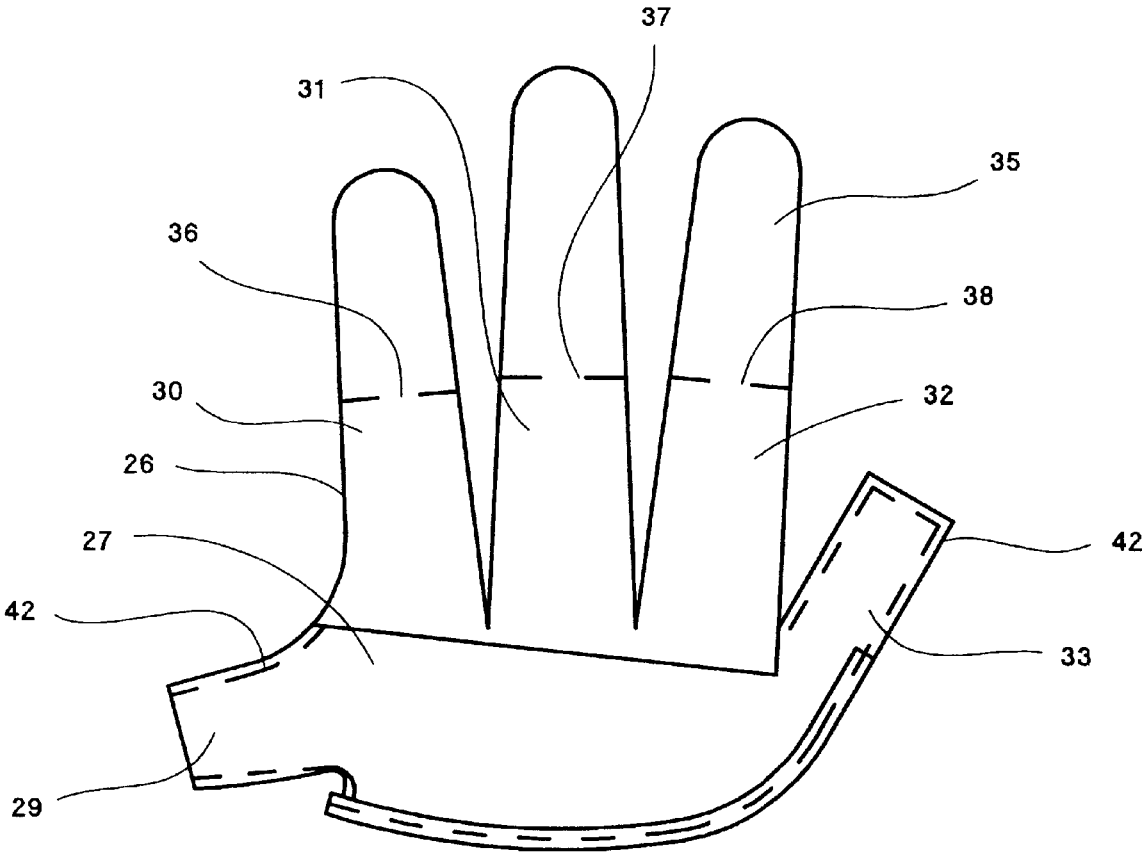
FIG.7 PRIOR ART
FIG. 7 is a front view of the inner lining of FIG. 3.

A layer of padding or cushion material 35 is secured to the front surface of each of the finger lining stalls 30–32 by three stitchings 36, 37, and 38, respectively (FIG. 7). The thumb lining stall 29 and the finger lining stalls 30-33 of the inner lining 26 are shorter than the thumb stall 15 and the finger stalls 16–19 of the outer shell 11, respectively, and the padding 35 extends beyond the distal ends of the finger stalls 30–32.

Figure 4:
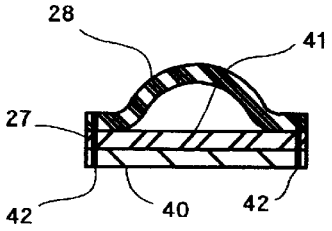
FIG. 4 is a sectional view taken along the line 4—4 of FIG. 3.
Figure 5:
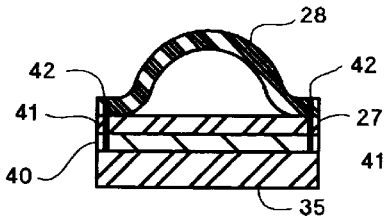
PRIOR ART FIG.5
FIG. 5 is a sectional view taken along the line 5—5 of FIG. 3.
Figure 6:
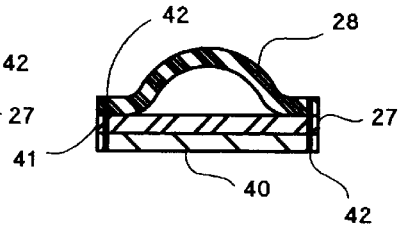
PRIOR ART FIG.6
FIG. 6 is a sectional view taken along the line 6—6 of FIG. 3.

Referring to FIGS. 4–6, the palm lining 27 includes a front layer 40 of felt or similar material and a back layer 41 of leather. The back lining 28 is preferably formed from leather. Other materials can also be used, such as, for example, synthetic leather. The back lining 28 and the layers 40 and 41 are secured along both sides of the thumb lining stall 29 and each the finger lining stalls 30–33 by a stitching 42.

The palm lining 27 extends across the front of the thumb lining stall 29 and each finger lining stalls 30-33 in a substantially flat configuration. The front or palm side of the thumb and each finger of the player contacts the flat palm lining 27, and the seams, which are formed where the palm lining 27 and back lining 28 are joined, can contact the relatively sensitive front surfaces of the fingers. The seams can therefore cause some discomfort to the player.

Referring now to FIGS. 8–13, the inventive inner lining 45 also includes a front or palm lining 46, a back lining 47, and a layer of padding or cushion material 48. The palm lining 46 and back lining 47 form a thumb lining stall 49 and four finger stalls 50, 51, 52, and 53 which fit inside of the thumb stall 15 and the finger stalls 16–19 of the outer shell 11 of the glove 10.

Figure 9:
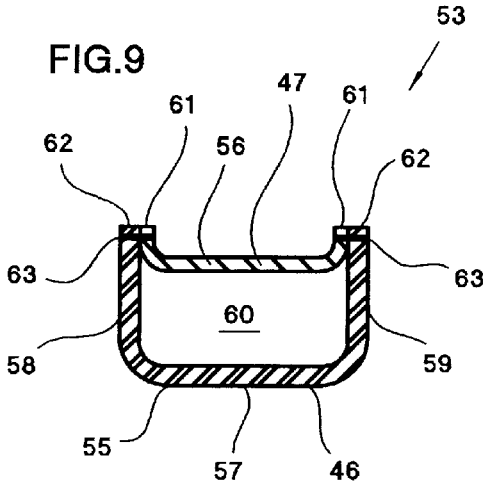
FIG. 9 is a sectional view taken along the line 9—9 of FIG. 8.
Figure 10:
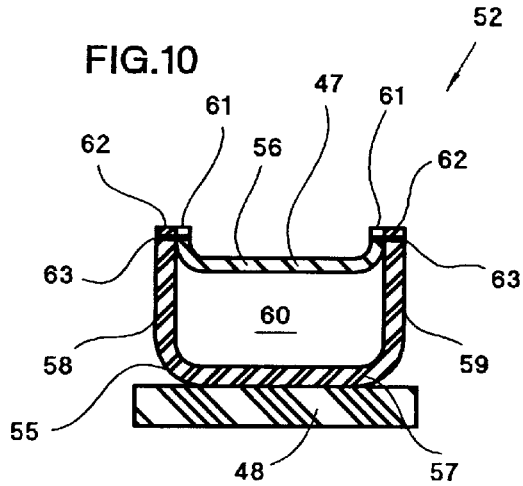
FIG. 10 is a sectional view taken along the line 10—10 of FIG. 8.
Figure 12:
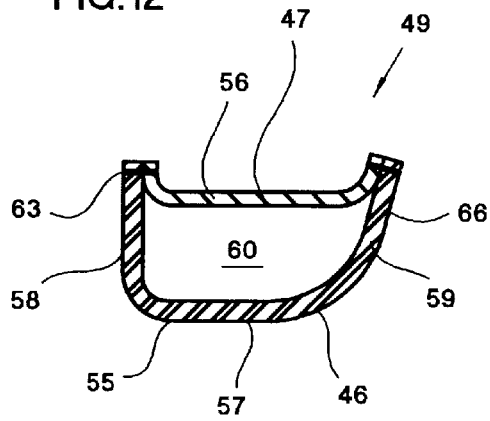
FIG. 12 is a sectional view taken along the line 12—12 of FIG. 8.

Referring to FIGS. 9, 10, and 12, the palm lining 46 provides a concavely curved front wall 55 for the thumb lining stall 49 and each of the finger lining stalls 50–53, and the back lining 47 provides a substantially flat back wall 56. The front wall 55 includes a curved front portion 57 and curved, rearwardly extending side wall portions 58 and 59. The curved front wall 55 and the back wall 56 provide a finger opening 60. The front wall 55 includes a convexly curved front surface and a concavely curved back surface.

The width of the back lining 47 along the thumb lining stall 49 and each of the finger lining stalls 50–53 is substantially less than the width of the palm lining 46, and the palm lining 46 is therefore retained in its curved configuration by the back lining 47. The back lining 47 includes rearwardly turned side edges 61 that are secured to the side edges 62 of the palm lining 46 by stitching 63. The stitching 63 is positioned rearwardly of the finger opening 60.

Figure 11:
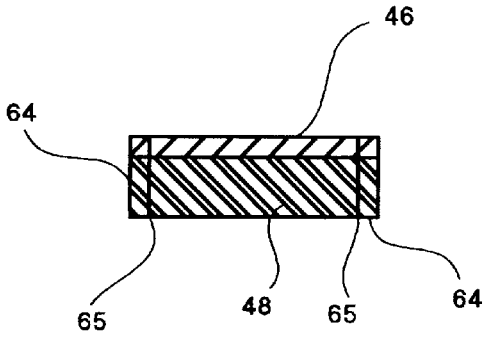
FIG. 11 is a sectional view taken along the line 11—11 of FIG. 8.

Referring to FIG. 11, in the particular embodiment illustrated, the palm lining 46 extends beyond the distal ends of the finger lining stalls 50–52 for the complete length of the padding 48 to form protections or extensions 64. The extensions 64 are flat and are secured to the padding 48 by stitching 65.

Figure 8:
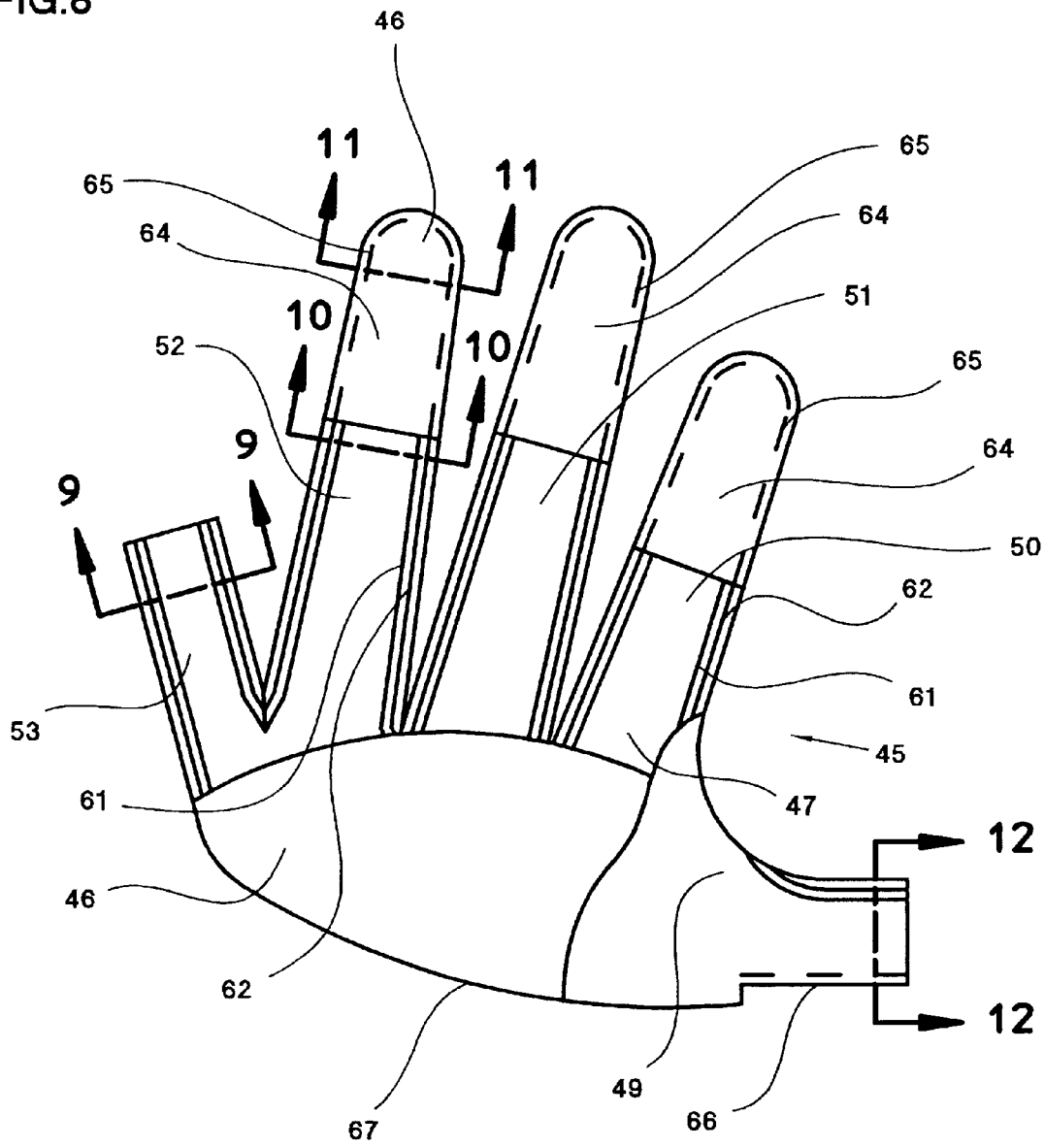
FIG. 8 is a back view of an inner lining formed in accordance with the invention.

Referring to FIGS. 8 and 12, the side edge 66 of the thumb stall 49 merges with the bottom edge 67 of the palm lining 46. The edge 66 is therefore not as rearwardly turned as the side edges of the other finger stalls.

The front or palm side of each of the player's thumb and fingers contacts the concavely curved front wall 55 of the thumb lining stall 49 and the finger lining stall 50–53. The seam which is formed where the palm lining 46 and back lining 47 are joined is positioned rearwardly of, and does not contact, the palm sides of the thumb and the fingers. The seams can contact only the backs of the thumb and fingers of the user, which are not as sensitive.

The curved front walls of the thumb lining stall 49 and the finger lining stalls 50–53 wrap around the thumb and fingers of the user like a hammock and provide much greater surface contact with the thumb and fingers than the substantially flat front walls of prior art linings. The greater surface contact between the thumb and fingers and the front walls allows the player to have greater control over the glove in order to catch and hold a ball.

Figure 14:
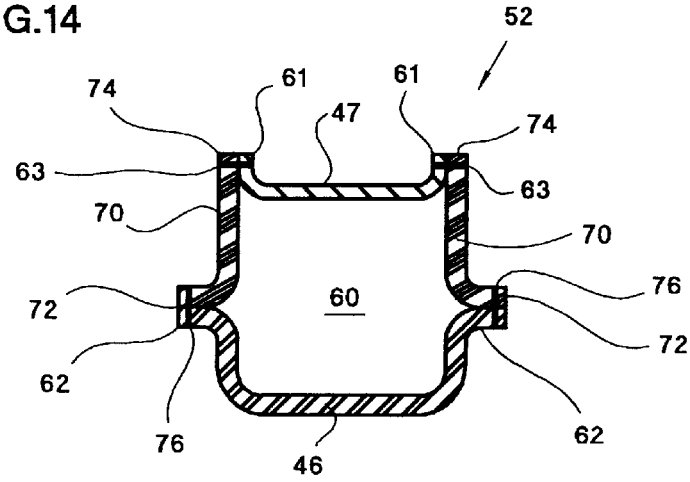
FIG. 14 is a cross-sectional view of a finger lining stall of a lining in accordance with an alternative preferred embodiment of the present invention.
Figure 13:
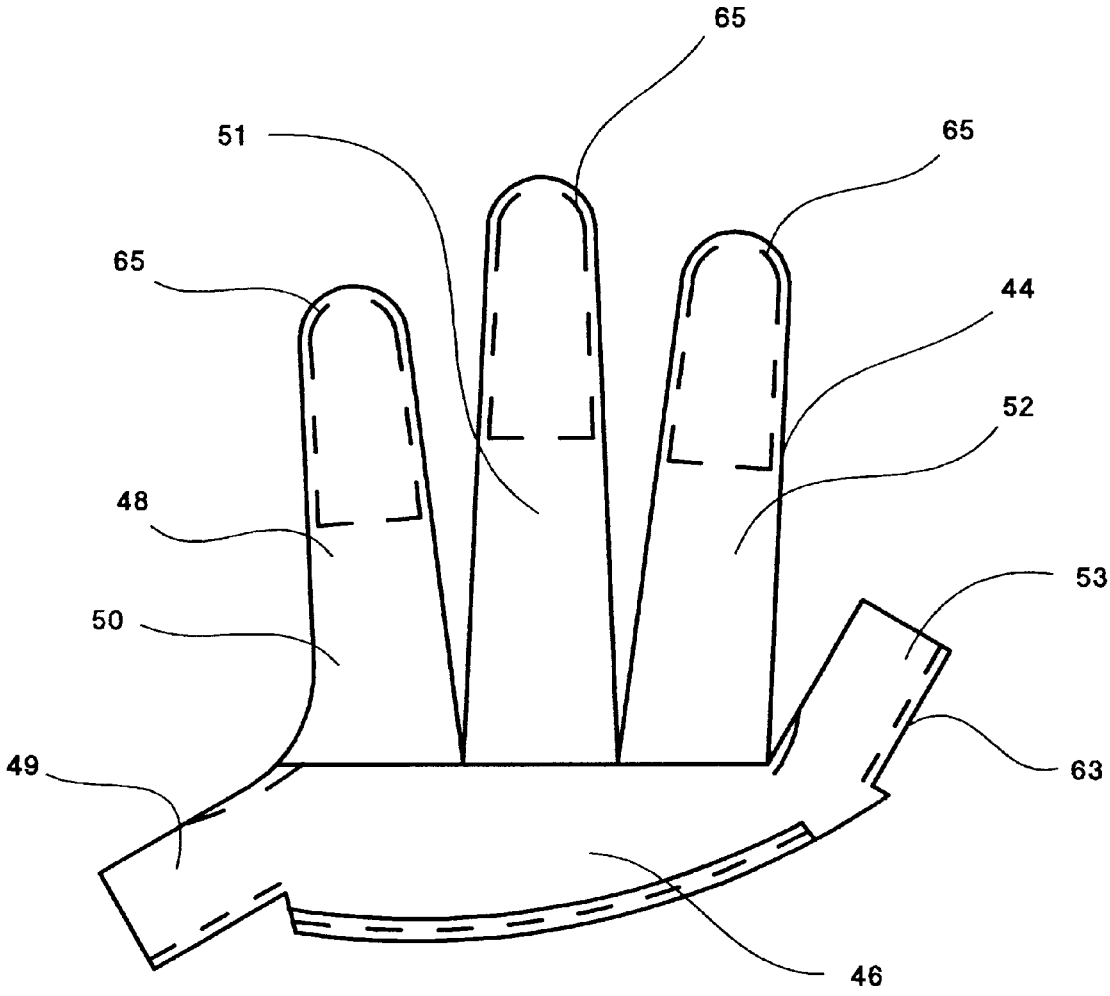
FIG. 13 is a front view of the inner lining of FIG. 8.

Referring to FIG. 14, in an alternative preferred embodiment, two longitudinally extending extension panels 70 can be installed between the palm lining 46 and the back lining 47 at each of the finger lining stalls 50–53. Each extension panel 70 includes a back edge 74 and a palm edge 72. The back edge 74 of the extension panel 70 is connected to one of the side edges 62 of the back lining 46, preferably through a stitching 76. Other connection means can also be used. The palm edge 72 is connected to one side edge 61 of the palm lining 46, preferably through the stitching 63. The use of the extension panels 70 enables the size of the finger opening 60 to be expanded. The extension panels 70 enable the palm lining 47 to be further spaced apart from a central portion of the back lining 46. The extension panels 70 further enable the width of the back lining 46 to be reduced, if desired. The back panel 46 and the extension panels 70 are preferably sized such that the seams created at the stitching 76 are positioned towards the back of the user's fingers.

While in the foregoing specification a detailed description of specific embodiments was set forth for the purpose of illustration, it will be understood that many of the details hereingiven may be varied considerably by those skilled in the art without departing from the spirit and scope of the invention.

We claim:

1. A ball glove having a thumb stall and a plurality of finger stalls, the ball glove comprising:

a palm lining having front and back surfaces;

a back lining coupled to the palm lining to provide a plurality of elongated finger lining stalls and a thumb lining stall, the finger lining stalls and thumb stalls being configured to generally fit within the finger stalls and the thumb stalls of the ball glove, respectively, the palm lining providing the finger lining stalls with longitudinally extending side edges and a curved transverse cross section in which the front surface of the palm lining is convexly curved and the back surface is concavely curved, the back lining coupled to the back surface of the palm lining adjacent to the side edges of each of the finger lining stalls, the back lining having an intermediate portion between the side edges of each of the finger lining stalls which is spaced from the palm lining to provide a finger opening; and a webbing extending between the thumb stall and one of the finger stalls.

2. The ball glove of claim 1 in which the back lining has a first transverse dimension between the side edges of each of the finger lining stalls and the palm lining at each of the finger lining stalls has a second transverse dimension, and wherein the first transverse dimension is less than the second transverse dimension between the side edges the same finger lining stall.

3. The ball glove of claim 1 in which the back lining is secured the palm lining adjacent the side edges of each of the finger lining stalls by stitching, the stitching being positioned rearwardly of the finger opening of the finger lining stall.

4. The ball glove of claim 1 in which the finger opening of each of the finger lining stalls is defined by a concavely curved front wall which is provided by the palm lining and a substantially flat rear wall which is provided by the back lining.

5. The ball glove of claim 4 in which each of the finger openings is also defined by curved side walls which are provided by the palm lining.

6. The ball glove of claim 4 in which the back lining is secured to the palm lining adjacent the side edges of each of the finger lining stalls by stitching, the stitching being positioned rearwardly of the rear wall of the finger opening.

7. The ball glove of claim 1, wherein the back lining is secured to the back surface of the palm lining.

8. The ball glove of claim 1, further comprising a plurality of longitudinally extending panel extensions, each panel extension having a palm edge and a back edge, the panel extensions connected to the palm lining at the plurality of palm edges of the panel extensions, and the panel extensions connected to the back lining at the plurality of back edges of the panel extensions, the panel extensions spacing apart the palm lining and the back lining.

9. The ball of claim 8, wherein the panel extensions are connected to the palm lining and the back lining by first and second stitchings, respectively.

* * * * *